United States Patent [19]

Morris

[11] 4,107,884

[45] Aug. 22, 1978

[54] CYLINDER RIDGE GRINDER

[76] Inventor: Charles F. Morris, 305 Stage St., Tenino, Wash. 98589

[21] Appl. No.: 738,371

[22] Filed: Nov. 3, 1976

[51] Int. Cl.[2] ..... B24B 15/02; B24B 19/00

[52] U.S. Cl. ..... 51/245; 90/12 R

[58] Field of Search ..... 51/241 R, 241 B, 241 A, 51/241 G, 241 S, 245, 239, 165.93; 90/12 R, 15 A

[56] References Cited

U.S. PATENT DOCUMENTS

| | | | |
|---|---|---|---|
| 1,031,934 | 7/1912 | Hunter | 51/241 B |
| 2,364,506 | 12/1944 | Berezny | 51/241 B |
| 2,535,587 | 12/1950 | McGovern et al. | 51/245 |
| 2,659,186 | 11/1953 | Burkholder | 51/245 |

*Primary Examiner*—Harold D. Whitehead
*Assistant Examiner*—Roscoe V. Parker

[57] ABSTRACT

A grindstone type of cylinder ridge remover to be used in conjunction with an electric drill for removing the ridge on the cylinder walls of piston type engines. The plate body of the cylinder ridge grinder rests on the top of the cylinder wall and is rotated by hand around the top of the cylinder wall, while an electric drill turns a grindstone by way of a shaft compatable to the chuck of the electric drill thus grinding away the ridge very effectively and very easily. The distance between the bottom of the body plate edge and the bottom of the grindstone, the depth into the cylinder which is to be ground, is regulated very exactly by an outside threaded sleeve bearing in complete control of the grindstone shaft being screwed up and down inside a threaded hub fixed to the body plate. The grinding depth position is locked by a thumb screw thru the hub side wall and against the outside of the sleeve bearing. Any normal size cylinder can be ridge ground without any complicated adjustments, very accurately since the stone cuts very gradually, and with little effort; a new, practical, the economical way of removing cylinder ridges.

2 Claims, 3 Drawing Figures

CYLINDER RIDGE GRINDER

SUMMARY OF THE INVENTION

A less expensive, less complicated, and less cumbersome cylinder ridge remover with more practicability was needed, especially for the amateur home mechanic. I think this ridge grinder fills that need very adequately.

DETAILED DESCRIPTION

Figure 1:
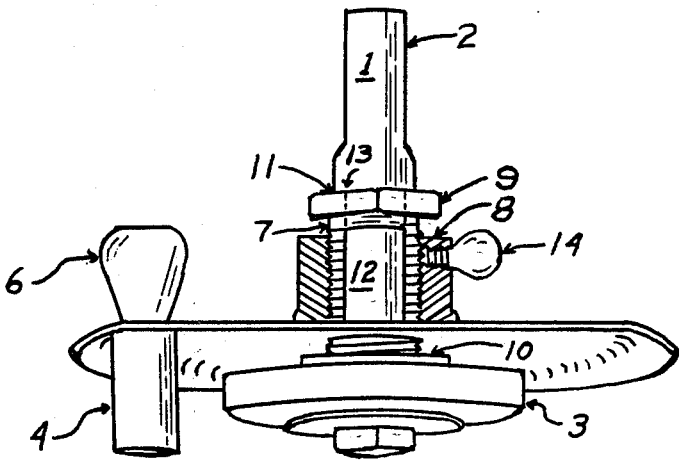
FIG. 1 is a perspective front view of the whole cylinder ridge grinder assembly including a grindstone in random grinding depth position from where it can be either raised or lowered. The center portion is shown in cutaway for better view in detail position of the outside threaded sleeve bearing, inside threaded hub, shaft, and position locking thumb screw. This fig. also shows the inside cylinder guide pin and the hand hold knob above it and their relative positions on the grinder body plate.

This cylinder ridge grinder incorporates several new ideas with advantages for removing the ridge on piston type engine cylinder walls. The power source can be any electric drill, the chuck of which is tightened to the round grinder shaft 1 at point 2. As best shown in drawing FIG. 3, with the drill and the grinder shaft in an upright position the grindstone 3 and guide pin 4 are inserted into the cylinder top opening 21 in a position whereby the downwardly extending round edge 17 of the body plate 5 rests evenly and flatly on the top of the cylinder wall 18 with the rounded side 17 of body plate 5 overlapping the cylinder wall segment where the grind is to start, and the grindstone 3 is against the ridge of the cylinder wall at this point 20. With the guide pin 4 also against the cylinder wall the ridge grinder along with the electric drill is rotated around the cylinder wall by one hand on the knob handle 6 and the other holding the drill, as many times as necessary, to remove the ridge on the cylinder wall. The grindstone turned by the electric drill will remove the ridge very evenly and gradually until it is smoothly even with the cylinder wall.

The grindstone may be changed to whatever size in diameter, thickness, or grit that is desired for any different personal preference or cylinder size. As well as changing the grindstone thickness the desired depth of grind downward along the cylinder wall into the cylinder is very accurately variable by the use of an outside threaded sleeve bearing 7 being screwed up and down into an inside threaded hub 8 which is fixed to the body plate. The sleeve type bearing has a nut type head 9 for easy turning and adjustment, and the bearing extends thru and under the body plate where it contacts a fixed washer 10 between the shaft 1 and grindstone 3; this restricts any upward movement of the grindstone toward the body plate. The downward movement of the grindstone away from the body plate is restricted by a larger diameter of the shaft at point 11 than the top inside diameter of the inside of the inside of the sleeve type bearing 7, as shown by dotted line 13. The shaft portion 12 is snugly fit to, but rotatable within this said inside 13 of the sleeve bearing. The desired depth of grind into the cylinder to properly remove the ridge is adjusted by screwing the sleeve type bearing 7 up or down inside the hub 8, whereby the distance between the bottom of the grindstone and the bottom of the body plate is varied. This adjustment is set by tightening the thumb screw 14, which is threaded thru the hub side, against the threaded outside of the sleeve bearing.

Figure 3:
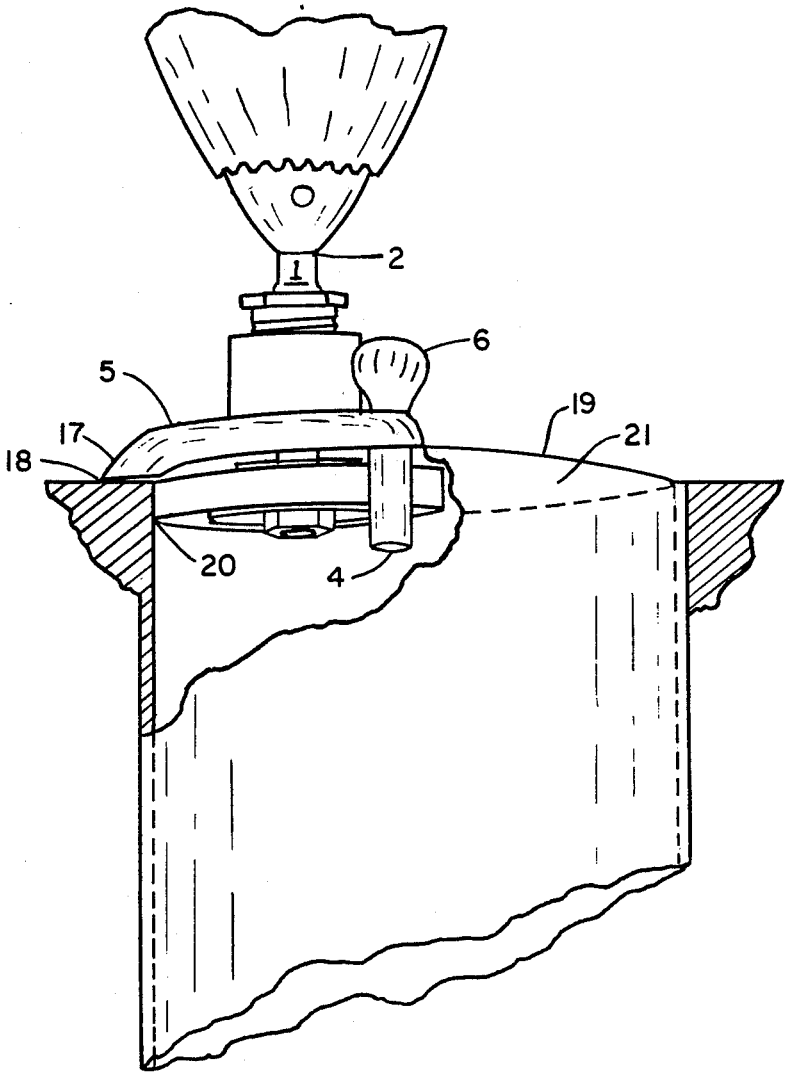
FIG. 3 is a front perspective view of the Cylinder Ridge Grinder in operative position on a random segment of the cylinder wall top and adjacent cylinder block top. The cut out portion of this figure shows how the body plate overlaps the grindstone in such manner that the downwardly extending round edge rests upon this cylinder wall top, while the grindstone and guide pin are inserted into the cylinder and are in contact with the inside cylinder wall near the top, and on a chord with the cylinder wall. This cut out portion also shows how the half clam shell body shape will accommodate the grindstone upwardly if the cylinder ridge to be ground is narrow in width, and the grindstone has to be raised to a maximum height.

The somewhat half clam shell shaped body plate is curved, bent, or cupped downward near its rounded edge but flat on its straight edge, and flat over the entire area above the grindstone. The reason for this shape, as best shown by the cut-out in FIG. 3, is to allow a closer distance if necessary between the rounded edge 17 of the body plate, which rests on the cylinder wall top 18 and the bottom of the grindstone, because the stone and associated washer can be partially drawn up into the shell shape. Also the body plate is strengthened by this shape, and the grinder can be rotated more easily and with more stability around the cylinder top while grinding.

Figure 2:
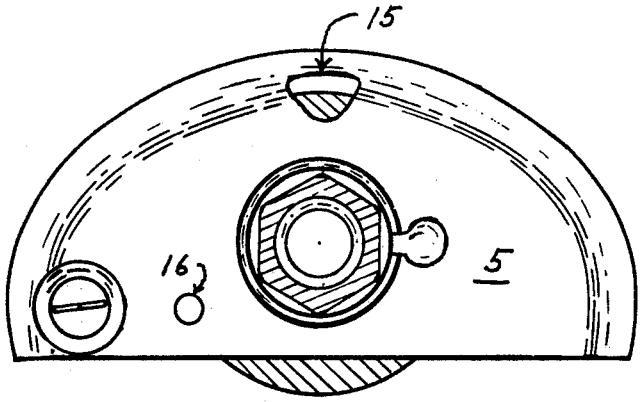
FIG. 2 is a top view of the cylinder ridge grinder better showing the shape of the body plate, the location of the grindstone under the body plate, the opening in the body plate for viewing the grindstone where it contacts the cylinder ridge, and the auxiliary hole to which the inside cylinder guide pin and hand hold knob can be moved when a smaller grindstone is used on a small diameter cylinder.

As shown in FIG. 2, hole 15 in the body plate 5 is for viewing the grindstone where it meets the cylinder wall ridge. Knob handle 6 and guide pin 4 can be moved to hole 16 if the cylinder to be ridge ground is small and the grindstone used is small thereby making the ridge grinder adaptable to most small cylinders.

I claim:

1. An electric drill powered cylinder ridge grinder having a body portion composed of a sheet metal plate; said plate including a semicircular plane section having a straight edge and a downwardly extending round edge; an internally threaded hub extending perpendicularly from one surface of said plate, in a direction opposite that of said round edge; and being disposed adjacent the center of said straight edge; an externally threaded sleeve bearing adjustably disposed internally of said hub and including a nut-type head above said hub; the sleeve bearing being of greater length than said hub and including locking means for adjustably securing said bearing in adjusted position; a shaft journaled in said bearing having means above said plate for connection to a power drill and means below said plate for mounting a grindstone; a flat grindstone carried by said shaft with a peripheral surface thereof disposed adjacent said downwardly extending round edge; a guide pin disposed along said straight edge and extending from said plate in the same direction as said grindstone; and a stabilizing knob disposed on said plate at said guide pin and extending from said plate in the direction of said drill whereby the grinder may be guided around the cylinder opening with the guide pin and the rotating grindstone in contact with the cylinder wall ridge.

2. The ridge grinder of claim 1 wherein said plane section of said plate includes a view window opening above said peripheral surface.

* * * * *